United States Patent [19]

Farrell

[11] 4,130,226

[45] Dec. 19, 1978

[54] GARMENT APPLYING DEVICE

[76] Inventor: Mary S. Farrell, 5331 Church Dr., Charleston, W. Va. 25306

[21] Appl. No.: 848,566

[22] Filed: Nov. 4, 1977

[51] Int. Cl.[2] ..... A47J 51/06

[52] U.S. Cl. ..... 223/111

[58] Field of Search ..... 223/111, 112, 113, 114, 223/115, 116, 117, 118; 16/111 A, 115; 248/100, 94

[56] References Cited

U.S. PATENT DOCUMENTS

| | | | |
|---|---|---|---|
| 1,010,037 | 11/1911 | Frisz | 16/115 X |
| 2,443,115 | 6/1948 | Park | 223/111 |
| 3,130,444 | 4/1964 | Stollsteiner | 16/111 A |
| 3,806,008 | 4/1974 | DeLettre | 223/111 |

*Primary Examiner*—George H. Krizmanich
*Attorney, Agent, or Firm*—William F. Frank

[57] ABSTRACT

A device for use by handicapped persons in applying garments to the lower extremities of the body comprising a garment supporting element including elements to hold the garment on the supporting means and a handle pivotally attached to the supporting means so that the handle may be folded over the supporting means when the device is not in use. The handle also carries a plurality of apertures to permit the handle to be adjusted relative to the hoop to compensate for the height of the user or the length of arms or the degree of flexibility that the user may have.

4 Claims, 5 Drawing Figures

GARMENT APPLYING DEVICE

FIELD OF THE INVENTION

The present invention relates to garment applicators, and more particularly it relates to a device to assist a handicapped person in putting on a garment on the lower extremities of the body.

PRIOR ART AND BACKGROUND OF THE INVENTION

The following patents are considered to relate to the field of the present invention: U.S. Pat. Nos. 3,692,217; 3,070,271; 2,888,177; 1,315,096.

Persons who suffer from arthritis, rhemuatism or as a result of injury frequently are unable to bend sufficiently from the waist or to bend their knees sufficiently to put on hoisery and other articles of clothing which are put on over the lower extremities of the body. This inability to dress oneself has an emotional and mental impact upon such a person because they are dependent upon another in the simple matters of dressing oneself.

To provide a relief for such persons many devices have been invented to assist in putting on stockings or shoes or trousers or skirts. Most of the devices employ clamps to hold the garments on a ring or Y-shaped article or have means by which the garment itself can be attached to the device. The devices are usually rigid and cumbersome. Some of the devices are partible when the garment has been put on the lower extremities sufficiently far so that the person can then reach the garment with his hands.

SUMMARY OF THE PRESENT INVENTION

The present invention embodies a hoop-like device over which the garment to be put on is placed and then held with a plurality of clamps to the hoop. The device includes a handle which is adjustable in length relative to the hoop so that the device may be used by persons of varying heights and arm reach. The device further embodies a folding aspect thus permitting the device to be made more compact for travelling or for carrying about.

BRIEF DESCRIPTION OF THE DRAWINGS

One embodiment of the present invention is shown in the accompanying drawings which are illustrative only and in no way restrict the scope of the present invention.

DETAILED DESCRIPTION OF THE INVENTION

Figure 1:
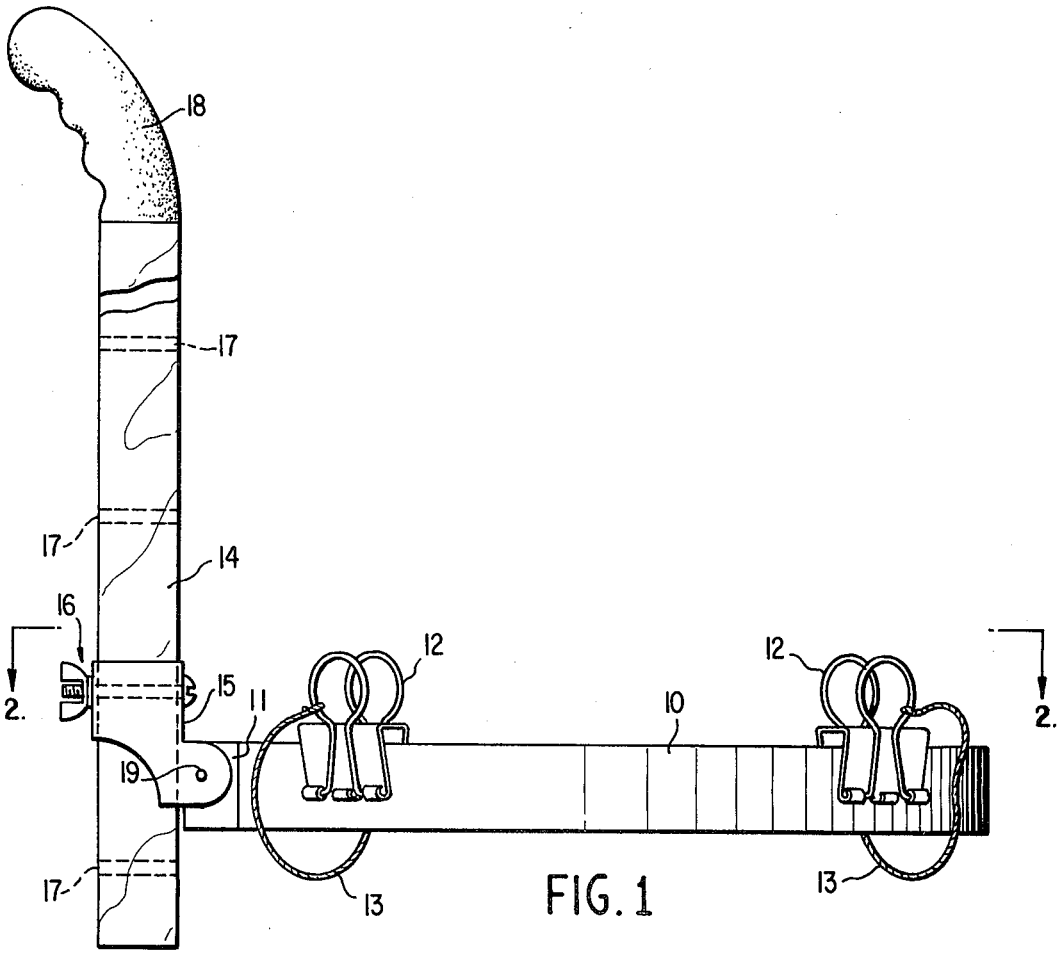
FIG. 1 is a side elevation of the view of the apparatus of the present invention.
Figure 2:
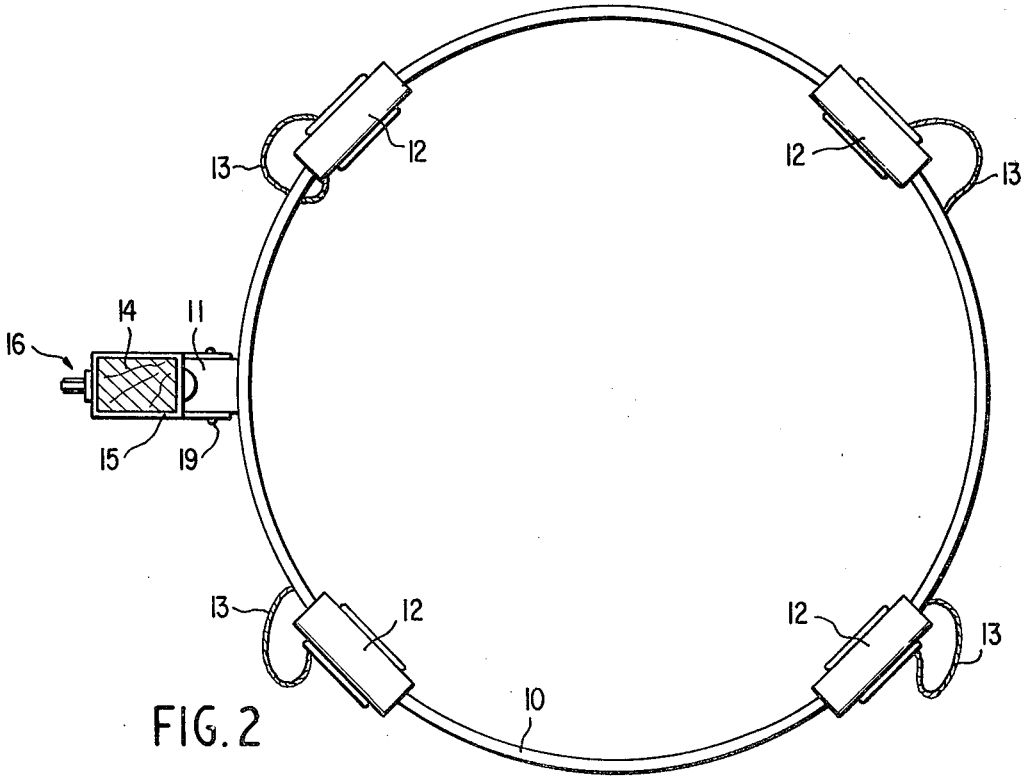
FIG. 2 is a top plan view of the device along the plane 2—2 in FIG. 1.

In FIG. 1 there is shown a hoop 10 which may be circular in nature for use in putting on stockings or it may be of oval configuration. When the device is used for putting on garments which must be drawn up over the hips, the hoop may be either circular or oval although the oval configuration would be more easily employed with the garments. The hoop is basically of cylindrical formation and may be made of wood or any suitable plastic. Extending from one edge of the hoop is a handle mounting base 11. In the instance when the hoop is made of wood, the base may be secured thereto by an adhesive or by means of any piercing element. Shown in FIG. 1 are a pair of clamp elements 12 which are attached to the apparatus, when not in use, by means of a tie 13. The tie may be any appropriate cord-like material of either natural or synthetic fibers. The ties are secured to the underside of the hoop by any appropriate means such as adhesive or by a piercing element. Normally four such clamp elements will be adequate even in the instance when the hoop is larger and is used for putting on undergarments as well as slacks or skirts. The handle 14 is attached to the handle mounting element 15 by means of a bolt and wing nut 16 of the conventional type. The handle at the lower portion thereof contains a plurality of spaced apertures 17 which provide means to adjust the hand grip 18 with reference to the hoop to provide for persons or longer or shorter arms as well as persons of different heights or persons who have varying degrees of restriction in their bending movements. A handle mounting element 15 is attached to the base 11 by means of a pin 19 on each side or it may be attached by means of a pin passing completely through the base as long as pivotal movement of the handle about the base is permitted. The hand grip may be smooth but preferably would be formed with a shape generally conforming to the fingers to provide better gripping by the user, particularly for those who may have arthritis in the hands and find it difficult to grip a smooth surface sufficiently tightly when putting on the garments.

Figure 3:
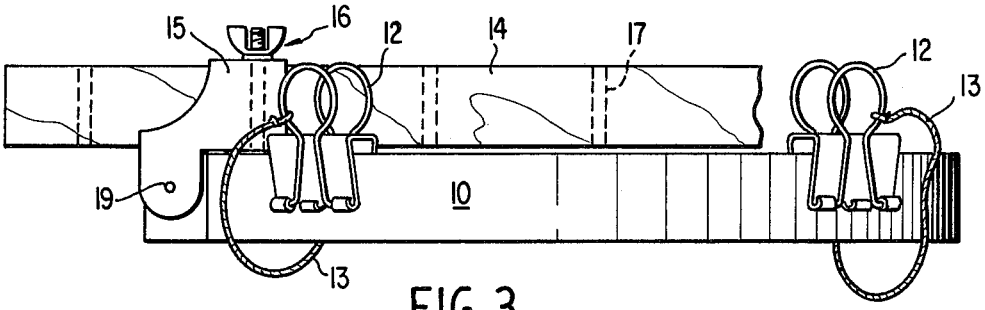
FIG. 3 is a side elevational view of the apparatus as shown in FIG. 1 with the handle in the folded position.

In FIG. 3, the present invention is shown with the handle folded down around pins 19 to lie more or less over the hoop 10. In this manner, the device can be collapsed for packing if the owner is taking a trip or for carrying with one in going to try garments on for purchase. Although the handle 14 is shown as solid in the illustrative embodiment in the drawings, it is considered that the handle also could be made to fold about its mid-portion to thus further decrease the space occupied by the device when not in use or when carried in one's suitcase or even a shopping bag. The means to make a folding handle are not shown but would be a conventional type means such as a hinged element with a sleeve or other means to slide down over the hinged portion when the handle is fully extended. Alternately the handle could be made in two parts, the upper portion having a hand grip 18 locking into the lower portion which is attached to the hoop.

Figure 4:
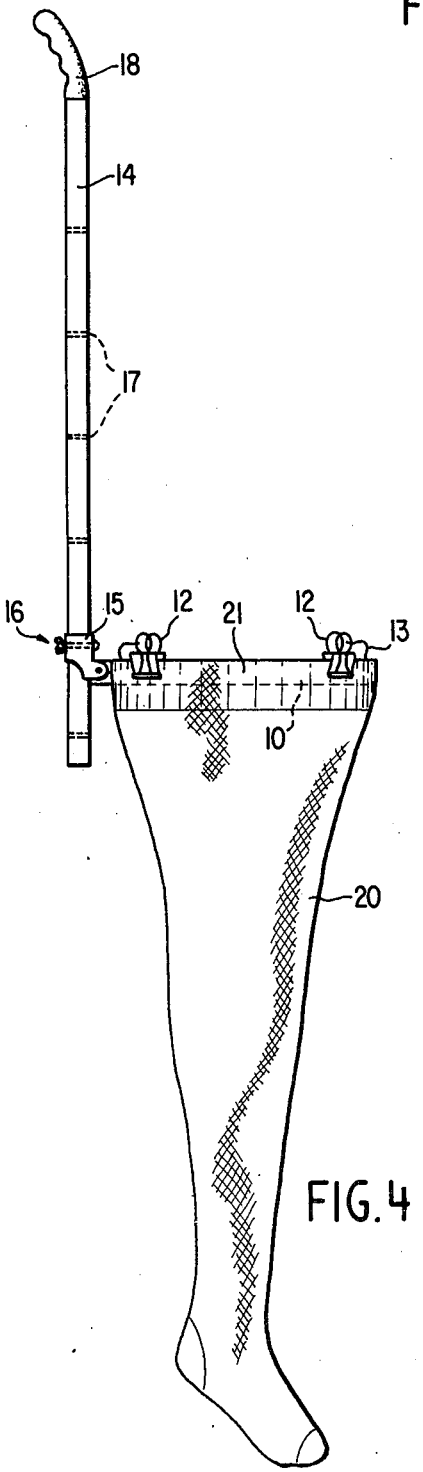
FIG. 4 is a side elevational view of the device of FIG. 1 showing a stocking attached thereto.
Figure 5:
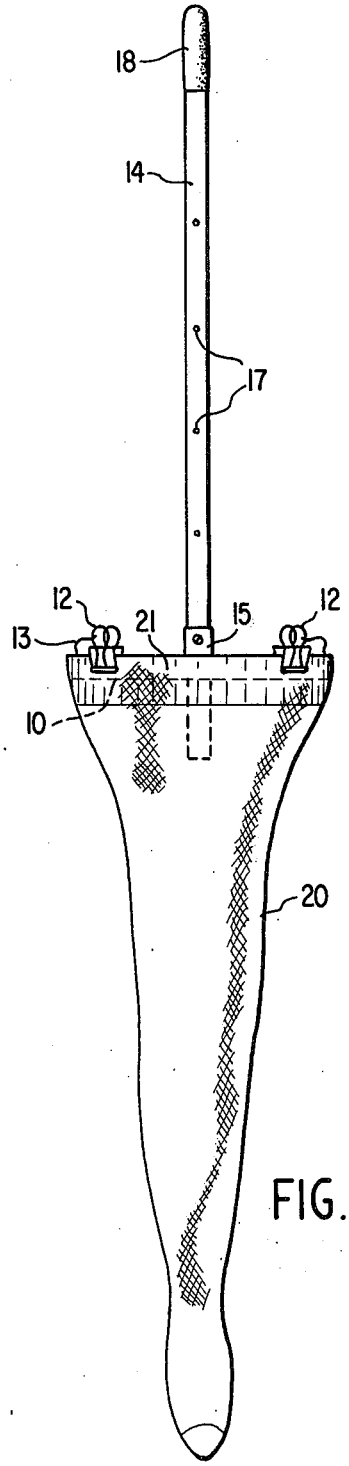
FIG. 5 is a frontal elevational view of the apparatus and stocking as shown in FIG. 4.

FIGS. 4 and 5 show the device in use for putting on a stocking 20. The stocking is inserted through the interior of the hoop and then the upper portion of the stocking 21 is folded over the hoop on the outside and the clamps are then placed over the stocking on the hoop. In this manner the stocking, or other garment, is firmly gripped on two sides of the hoop, thereby providing a more secure holding of the stocking or garment on the hoop.

The hoop may be of wood or a moldable plastic or if desired could be made of a lightweight metal or metal alloy. The handle, while shown to have a rectangular cross-section, could be circular in cross-section or oval in cross-section. In either instance the handle mounting base 11 would have a surface adjacent the handle to conform to the outer surface of the handle. The fact that the hoop has a right cylindrical outer surface with its mounting element for the handle particularly improves the rigidity and strength of the device because the handle on its surface adjacent the handle mounting base will bear against this providing good leverage for the user. While the hoop 10 is shown to have a right cylindrical outer and inner surface, the hoop could be of an oval configuration or even of circular configuration. It is believed that whatever the cross-section of the hoop is chosen to be, should provide for maximum possible bearing surface for the clamps and the garments, particularly so that the garments would not tend to roll inwardly as they are put on due to the pressure exerted within the hoop as the garment is pulled over the foot end or legs. The clamp ties 13 provide a safety feature for the device in that even when the clamps are not put on the hoop when the device is not in use there is little or no danger of them becoming lost or misplaced. The shape of the clamp may vary from that shown in the drawings depending upon the skill and knowledge of those in the field.

What is claimed is:

1. A garment applying device comprising a hoop-like element to receive a garment to be put on the lower extremities of the body, a plurality of clamps to hold the garment on the hoop-like element, a handle removably attached to a pivotal handle mounting element which is positioned on one side of the hoop, said handle having a plurality of spaced apertures along its length to adjustably position the handle within the handle mounting element relative to the hoop-like element, means passing through said apertures and said mounting element to secure and adjustably position said handle within said mounting element, and means on the end of the handle to be gripped by the hand of the user.

2. The device according to claim 1 wherein said hoop is of a right cylindrical form having a circular form.

3. The device according to claim 1 wherein said handle may be folded back upon itself for storage or carrying purposes when not in use.

4. An improvement in apparel applying devices having means to support a piece of apparel in position to be gone over the lower extremities of the human body including means to secure the piece of apparel to the apparel supporting means and a handle pivotally attached to said apparel supporting means, the improvement comprising handle mounting means pivotally attached to one side of said apparel supporting means to receive said handle and permit said handle to be folded across said apparel supporting means when said device is not in use, said handle being adapted to be folded back on itself for carrying or storage when not in use, a plurality of apertures in the lower portion of said handle to permit said handle to be adjustably positioned relative to said hoop within said pivotally mounted handle mounting means and means passing through said apertures and mounting element to secure said handle within said mounting element.

* * * * *